US005881880A

United States Patent [19]

Jacques et al.

[11] Patent Number: 5,881,880

[45] Date of Patent: Mar. 16, 1999

[54] NESTABLE LID

[75] Inventors: Michel Jacques, St-Damien; Roch Nolet, St-Joseph-de-Beauce, both of Canada

[73] Assignee: IPL, Inc., St. Damien, Canada

[21] Appl. No.: 957,074

[22] Filed: Oct. 23, 1997

[51] Int. Cl.[6] ..... B65D 43/03

[52] U.S. Cl. ..... 206/518; 206/515; 206/504; 220/380

[58] Field of Search ..... 220/608, 380, 220/4.28; 206/386, 600, 508, 515, 518, 504

[56] References Cited

U.S. PATENT DOCUMENTS

| | | | |
|---|---|---|---|
| 3,084,830 | 4/1963 | Koelsch | 206/504 |
| 3,338,468 | 8/1967 | Wilson | 220/380 |
| 3,419,184 | 12/1968 | Asenbauer | 206/508 |
| 3,759,416 | 9/1973 | Constantine | 206/508 |
| 3,771,646 | 11/1973 | Mascetti, Jr. | 206/518 |
| 4,244,471 | 1/1981 | Plante | 206/386 |
| 4,480,748 | 11/1984 | Wind | 206/386 |
| 4,673,087 | 6/1987 | Webb | 206/508 |
| 5,042,674 | 8/1991 | Ramsay et al. | 206/508 |
| 5,062,539 | 11/1991 | Chandler | 206/508 |
| 5,096,083 | 3/1992 | Shaw et al. | 220/380 |
| 5,133,460 | 7/1992 | Shuert | 206/386 |
| 5,507,389 | 4/1996 | Syrek | 220/608 |
| 5,515,987 | 5/1996 | Jacques et al. . | |

FOREIGN PATENT DOCUMENTS

| | | | |
|---|---|---|---|
| 110754 | 4/1961 | Pakistan | 206/508 |
| 950344 | 2/1964 | United Kingdom | 206/508 |
| 2059920 | 4/1981 | United Kingdom | 220/608 |

*Primary Examiner*—Stephen Castellano
*Attorney, Agent, or Firm*—Merchant, Gould, Smith, Edell, Welter and Schmidt

[57] ABSTRACT

A container lid has a top wall with a series of recessed areas that include therewithin a plurality of geometrical projections and a bottom wall that displays a plurality of recesses complementary in shape to the projections of the top wall whereby identically shaped lids may be stacked or cross-stacked in nested condition with the projections of one lid being received in the corresponding recesses of a superposed lid. The lid is adapted to be affixed to a container having four side pieces and a bottom piece, the configuration of the lid allowing a stacking or cross-stacking arrangement of lid-covered containers with their side pieces in the erected position as well as the stacking or cross-stacking of lid-covered containers with their side pieces in an inwardly folded position.

6 Claims, 10 Drawing Sheets

130
121
132f
104
132e
132d
132d
122f
122e
132e
122d
140
130
132f
134
112
122a
136
124
132a
128
126
132b
130
122b
130
122c
138
132c

NESTABLE LID

FIELD OF THE INVENTION

The present invention pertains to a lid which is so configured as to enable its stacking or cross-stacking with identical lids as well as the stacking or cross-stacking of lid-covered containers, whether the container sides are in an erected position or in a folded position over their bottom.

BACKGROUND OF THE INVENTION

In applicant's co-pending application, U.S. Ser. No. 835,752 filed Apr. 8, 1997, there is described a five-piece open container consisting of a bottom piece and of four side pieces, each side piece having a lower edge pivotally connected to the bottom piece. The bottom piece displays at each corner a vertically extending post which cooperates with a post-receiving recess on the underside of the bottom piece to lockingly engage the containers allowing them, with their side pieces in an inwardly folded position over the bottom piece, to be stacked with similarly-constructed containers.

OBJECTS AND STATEMENT OF THE INVENTION

An object of the present invention is to provide a lid for use with such containers as described above.

It is another object of the present invention to configure the top and bottom walls of the lids so that they may be stacked as well as cross-stacked in a nested condition.

It is a further object of the present invention to enable the above described containers to be stacked or cross-stacked with lids in a covered arrangement when the container side pieces are in the erected position.

It is still a further object of the present invention to enable these lids and containers to be stacked or cross-stacked with the container side pieces in an inwardly folded position over their bottom piece.

The present invention therefore relates to a container lid consisting of a body having a top wall and a bottom wall, the top wall having a peripheral edge and displaying a series of recessed areas including therewithin a plurality of geometrical projections, each projection having a top face extending in a plane substantially coinciding with that of the peripheral edge; the bottom wall displays a plurality of recesses complementary in shape to the projections on the top wall whereby identically-shaped lids may be stacked in nested condition with the projections of one lid being received in corresponding recesses of a superposed lid.

In one form of the invention, the body of the lid is rectangular with long and short sides, the configuration of the lids being such that superposed lids may be stacked as well as cross stacked.

The present invention also relates to the novel combination of a lid and a five-piece container, the container consisting of four side pieces having upper edges and lower edges pivotally connected to side edges of a bottom piece so as to move between two positions including an erected position and an inwardly folded position. The bottom piece displays, on its upper side, vertically extending post means at each corner thereof and, on its under side, a series of geometrical configurations of projecting ribs defining a plurality of cavities. The lid consists of a body having a top wall and a bottom wall, the top wall displaying a peripheral edge defining therewithin a series of recessed areas including therewithin a plurality of geometrical projections, each projection having a top face extending in a plane substantially coinciding with the peripheral edge. The bottom wall displays a plurality of geometrical recesses complementary in shape to that of a corresponding projection of the top wall whereby, when the side pieces of the five-piece container are in the erected position, the peripheral edge of the lid is engaged to the upper edges of the side pieces to cover the lid and lid covered containers may be stacked with the lid projections being received in corresponding cavities of the under side of a superposed container and whereby, when the side pieces of the container are in the inwardly folded position, the lid rests on the post means so that folded containers with lids thereon may be stacked with the projections of the lid being received in corresponding cavities of the under side of a superposed side-folded container.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

IN THE DRAWINGS

FIG. 3 is an elevational view of a long side thereof;

DESCRIPTION OF PREFERRED EMBODIMENTS

Figure 1:
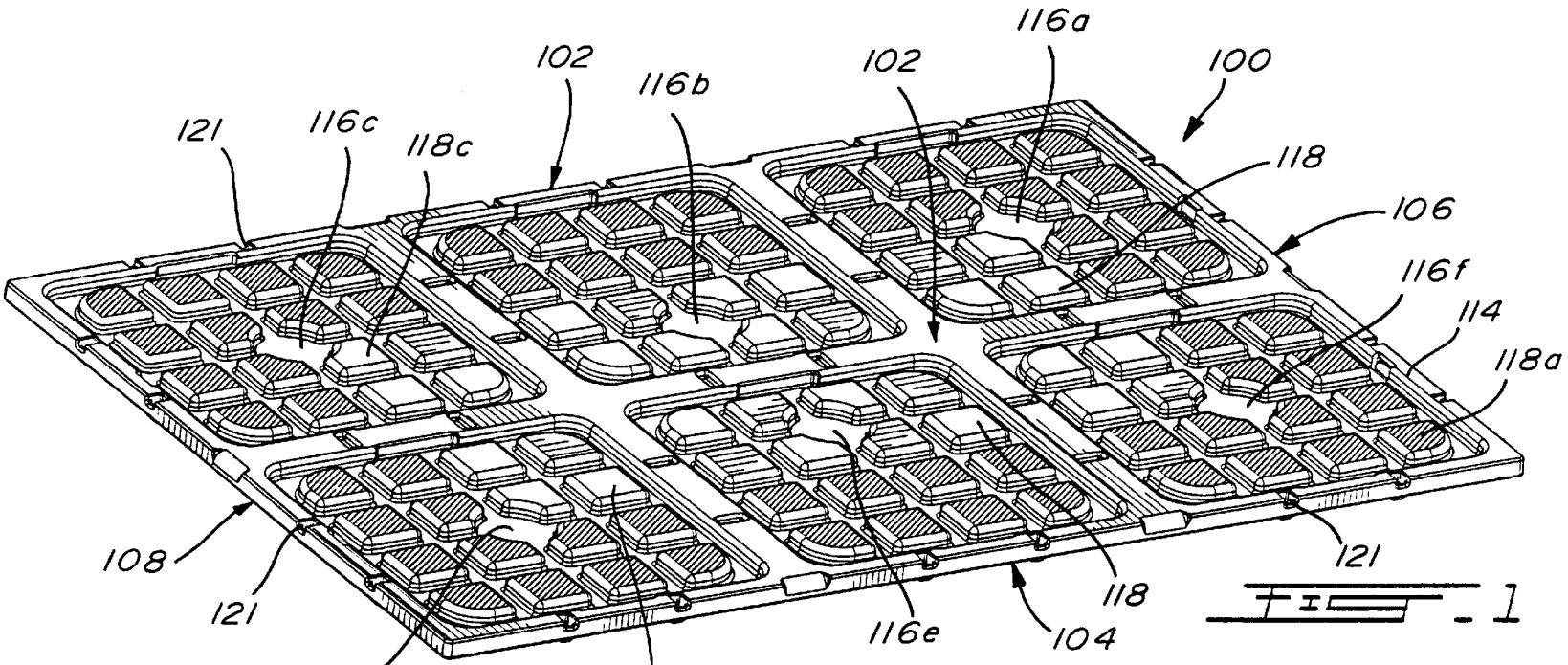
FIG. 1 is a top perspective view of a lid made in accordance with the present invention.
Figure 2:
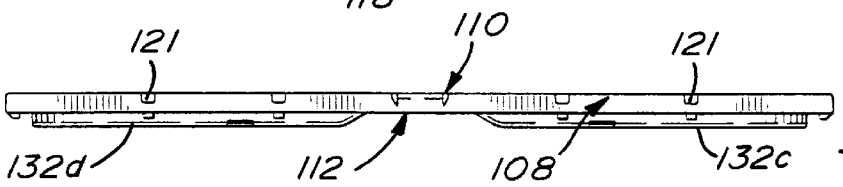
FIG. 2 is an elevational view of a short side thereof.

Referring to FIGS. 1 to 6, there is shown a lid 100 made in accordance with the present invention. The lid has a rectangular body of plastics material with opposite long sides 102 and 104 and opposite short sides 106 and 108; the lid also has a top wall 110 and a bottom wall 112. The top wall displays a rectangular peripheral edge 114 and a series of recessed areas 116 (six being shown in the embodiment illustrated as 116*a* to 116*f*. Each recessed area includes therewithin a plurality of geometrical projections, generally denoted 118. In the embodiment illustrated, each recessed area is generally square-shaped with rounded corners; most of the projections are square- shaped with the exception of corner projections, such as 118*a*, and some inner projections, such as 118*c*.

Peripherally spaced along the short sides 106 and 108, and long sides 102 and 104 is a series of grooves 121, the function of which will be described further hereinbelow.

Some of the top faces of the projections 118 are plane, others are rugged to provide friction; each projection extends in a plane substantially co-planar with that of the peripheral edge.

Figures 4, 5:
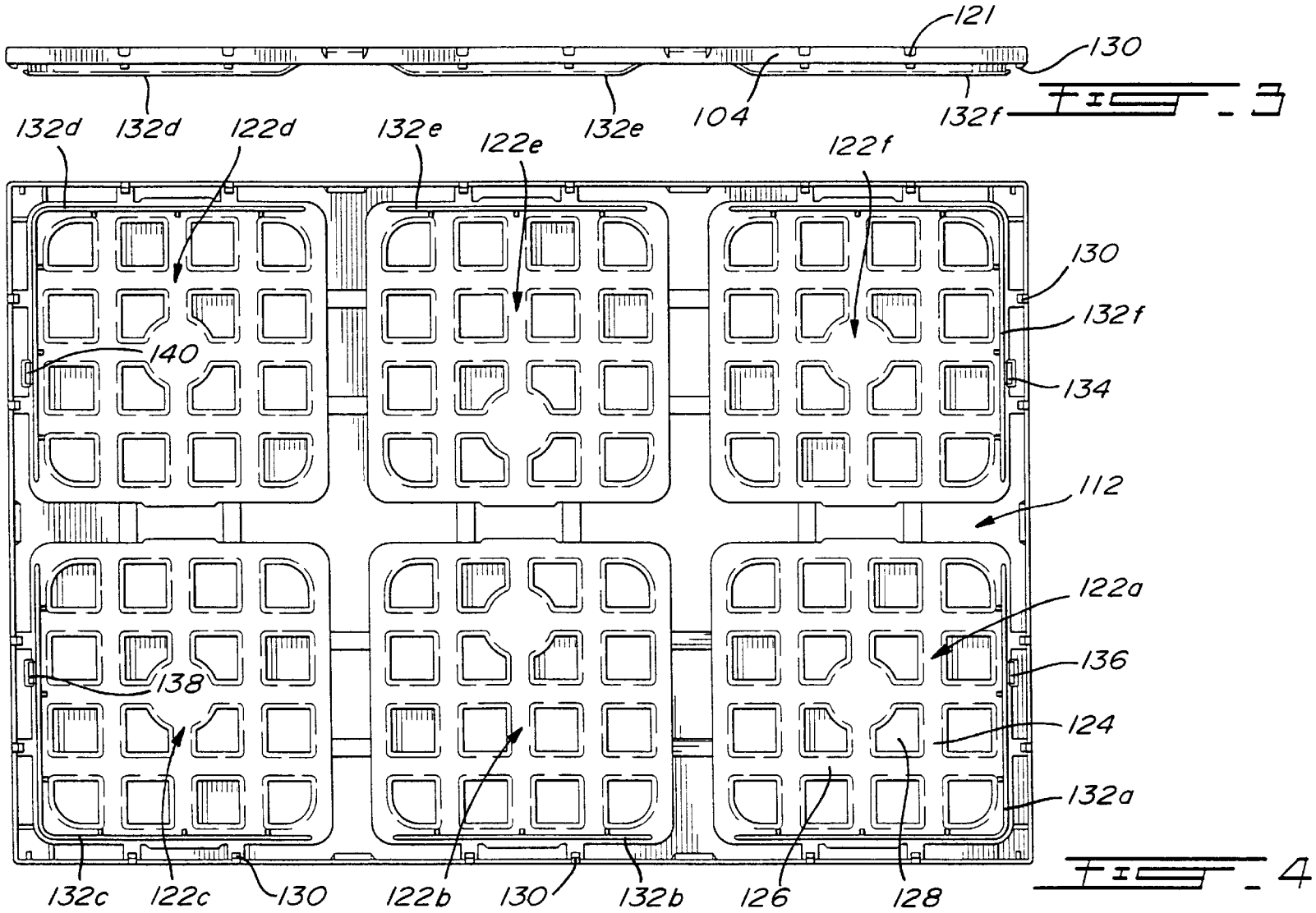
FIG. 4 is a bottom plan view thereof.
FIG. 5 is a top plan view thereof.
Figure 5:
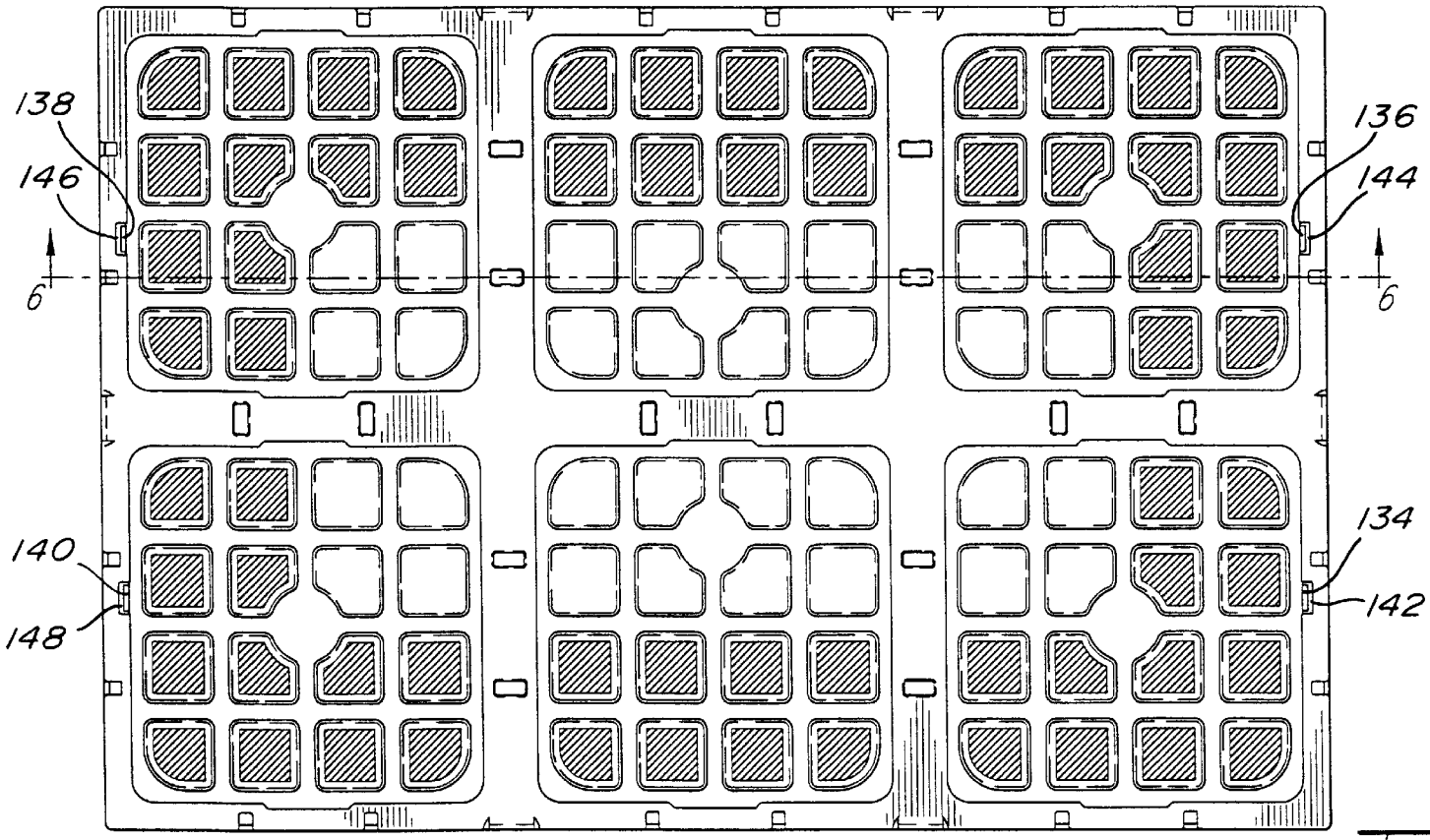
Figure 6:
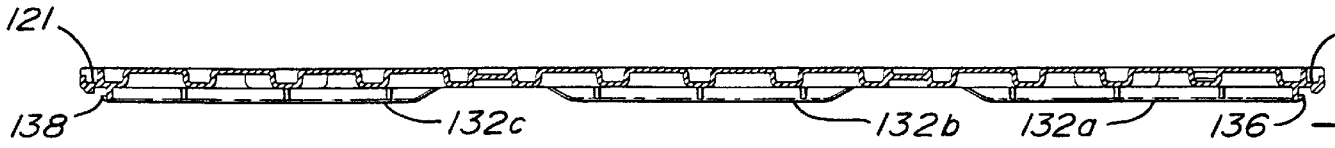
FIG. 6 is a cross-sectional view taken along lines 6—6 of FIG. 5.

Referring to FIG. 4, the bottom wall 112 displays a series of grid-like configurations 122 (six being shown as 122*a* to 122*f*) which are complementary in shape to recessed areas 116 of the top wall 112 described above. Each grid-like configuration comprises a series of ribs 124 and 126 that define a plurality of recesses 128 which, again, correspond in a complementary manner to the shape of the projections 118 of the top wall 112. The bottom wall also includes a series of downward projections 130 which are located vertically beneath corresponding grooves 121.

The outer edge of each grid-like configuration of the bottom wall displays a longitudinal projecting rib 132 (six being shown as 132*a* to 132*f*; corner ribs 132*a*, 132*c*, 132*d* and 132*f* being L-shaped).

On the outer wall of some of these ribs are provided snap projections which may be seen on the short side of the lid, such as projections 134, 136, 138, 140. These snap projections are vertically aligned with small rectangular openings 142, 144, 146, 148, respectively, on the short side of the lid body.

Figure 7:
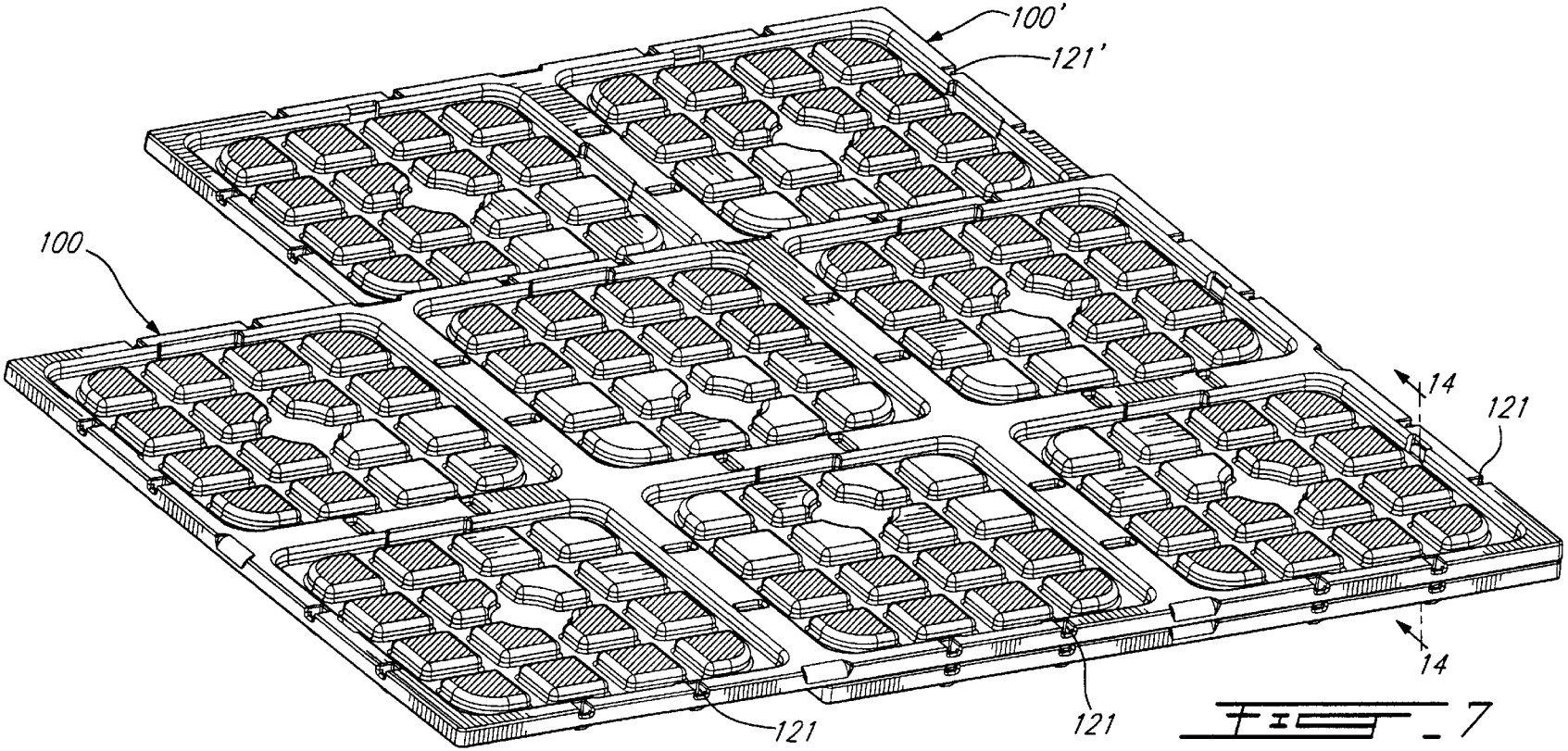
FIG. 7 is a top perspective view showing two lids in cross-stacked arrangement.

Referring to FIG. 7, the construction of the lid is such that it may be stacked or cross-stacked with identically shaped lids, such as the two lids illustrated as lids 100 and 100'. Whether in the stacked or cross-stacked condition, the lids are fixedly engaged to one another by having their projections 130 of their bottom wall received in corresponding grooves 121 of the top wall of a lid stacked therebeneath as well as by having their longitudinal ribs 132 in the recessed areas of the top wall.

Figure 8:
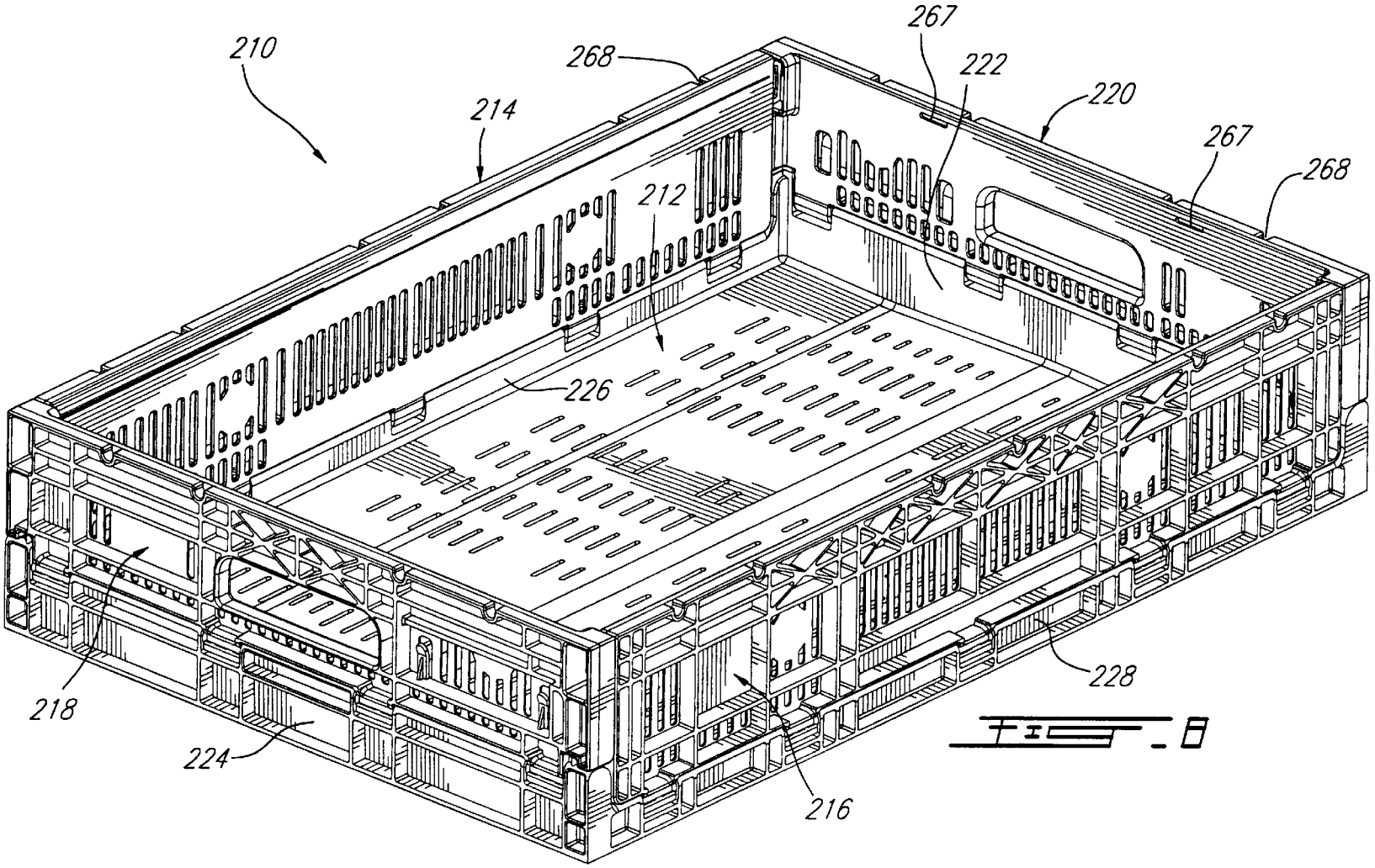
FIG. 8 is a top perspective view of one embodiment of a container used in the combination of the lid of the present invention.

Referring to FIG. 8, there is shown a five-piece open container, generally denoted 210, made entirely and solely of rigid plastics material. The container consists of a bottom piece 212, of opposite side pieces 214 and 216 and of opposite end pieces 218 and 220.

The structural appearance of the five pieces of the container is conventional consisting of reinforcing ribs on their outer walls and a plurality of openings to provide rigidity and lightness (and aeration in some cases). The end pieces also have larger openings in their upper part providing handles for carrying the container.

Figure 9:
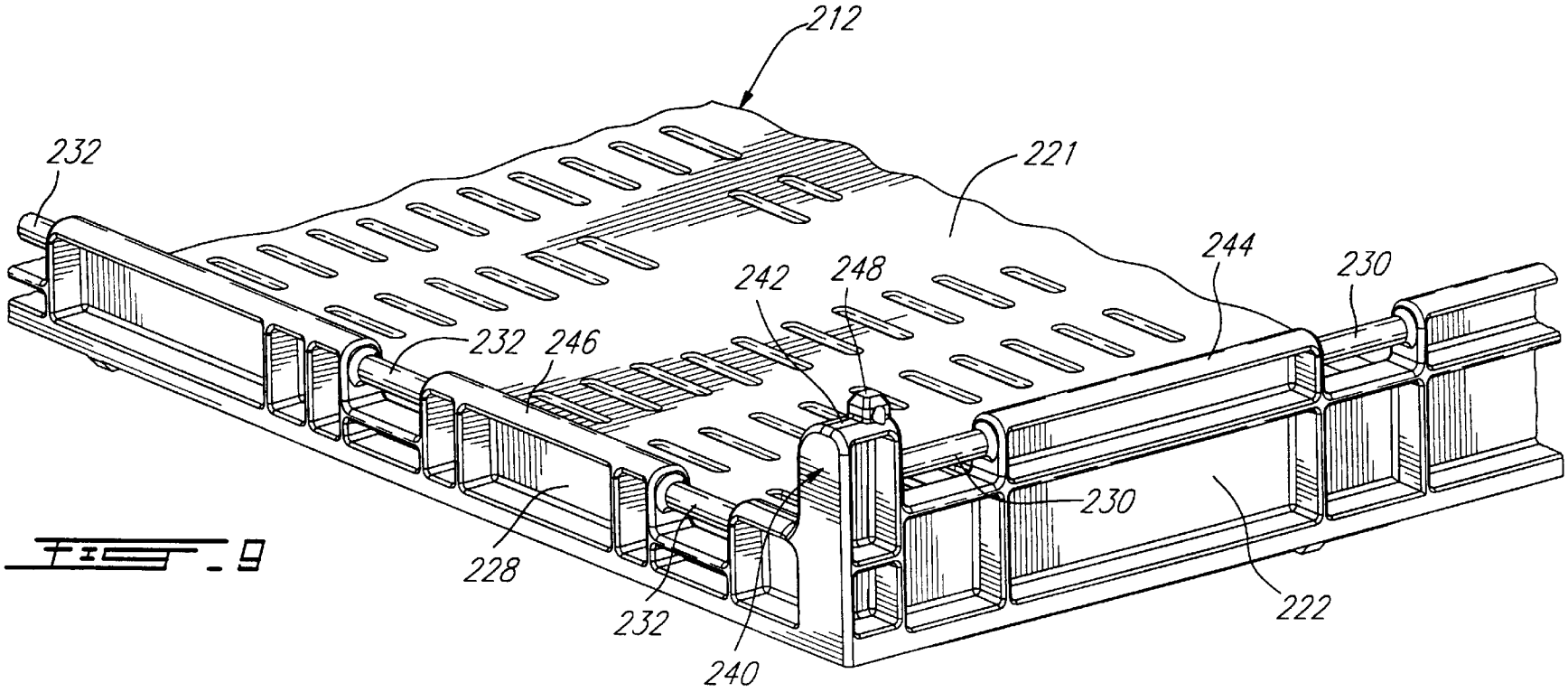
FIG. 9 is an enlarged perspective view partially showing a corner area of the bottom piece of the container.

The side and end pieces are pivotally connected along their lower edge to a series of hinges (such as 230 and 232 in FIG. 9) integrally formed along the upper edge of the opposite end walls 222 and 224 and opposite side walls 226 and 228 of the bottom piece 212. The particular connection of the opposite side pieces and end pieces to these hinges 230 and 232 may be found described in U.S. Pat. No. 5,515,987 issued May 14, 1996 to the present assignee. Therefore, a detailed description of this connection will not be described herein.

The bottom piece 212 has an upper side displaying a top face 221 which is delimited by the opposite end walls 222 and 224 and the opposite side walls 226 and 228.

At each corner of the bottom piece 212, there is provided a post, generally denoted 240, having the same construction at each corner. Each post 240 consists of a vertically extending rectangular corner projection having a curved top wall 242 which is slightly higher than the upper edges 244 and 246 of the walls 222 and 228 (as well as walls 224 and 226). Extending upwardly from the top wall 242 of the post 240, is a pyramidally shaped integral part 248, the function of which will be described hereinbelow.

Figure 10:
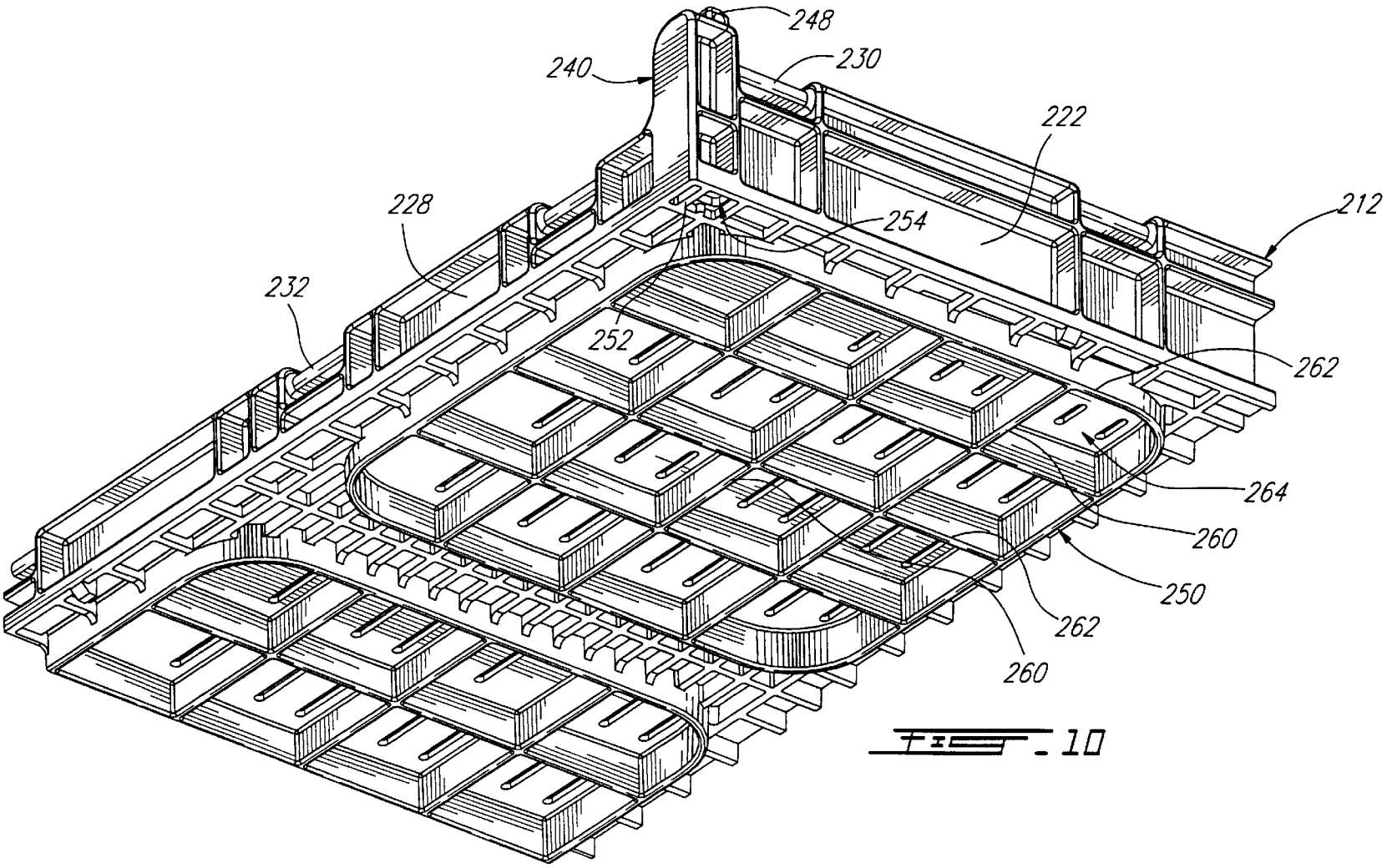
FIG. 10 is an enlarged bottom perspective view of the corner area shown in FIG. 9.

Referring to FIG. 10, the under side of the bottom piece 212 has a grid-like configuration 250. Each corner of this under side displays a rib 252 with a recessed cavity or opening 254. This particular corner construction of the under side of the container is such that the top wall 242 of a post of a similarly-constructed container will bear against rib 252 with its extension 248 received in the cavity 254 providing a locking arrangement when two containers are stacked together. Hence, when the side and end pieces are folded inwardly over the top face 221 of the bottom piece (or alternatively folded outwardly) a column of these containers may be formed and adequately secured by the four posts of the container which are fixedly engaged in the underside corners of superposed containers. The underside may include a series of grid-like configurations 250 which are formed of a series of ribs 260 and cross-ribs 262 defining a series of cavities 264. In the embodiment illustrated, the configurations and the cavities are square shaped, except for rounded corners.

Figure 11:
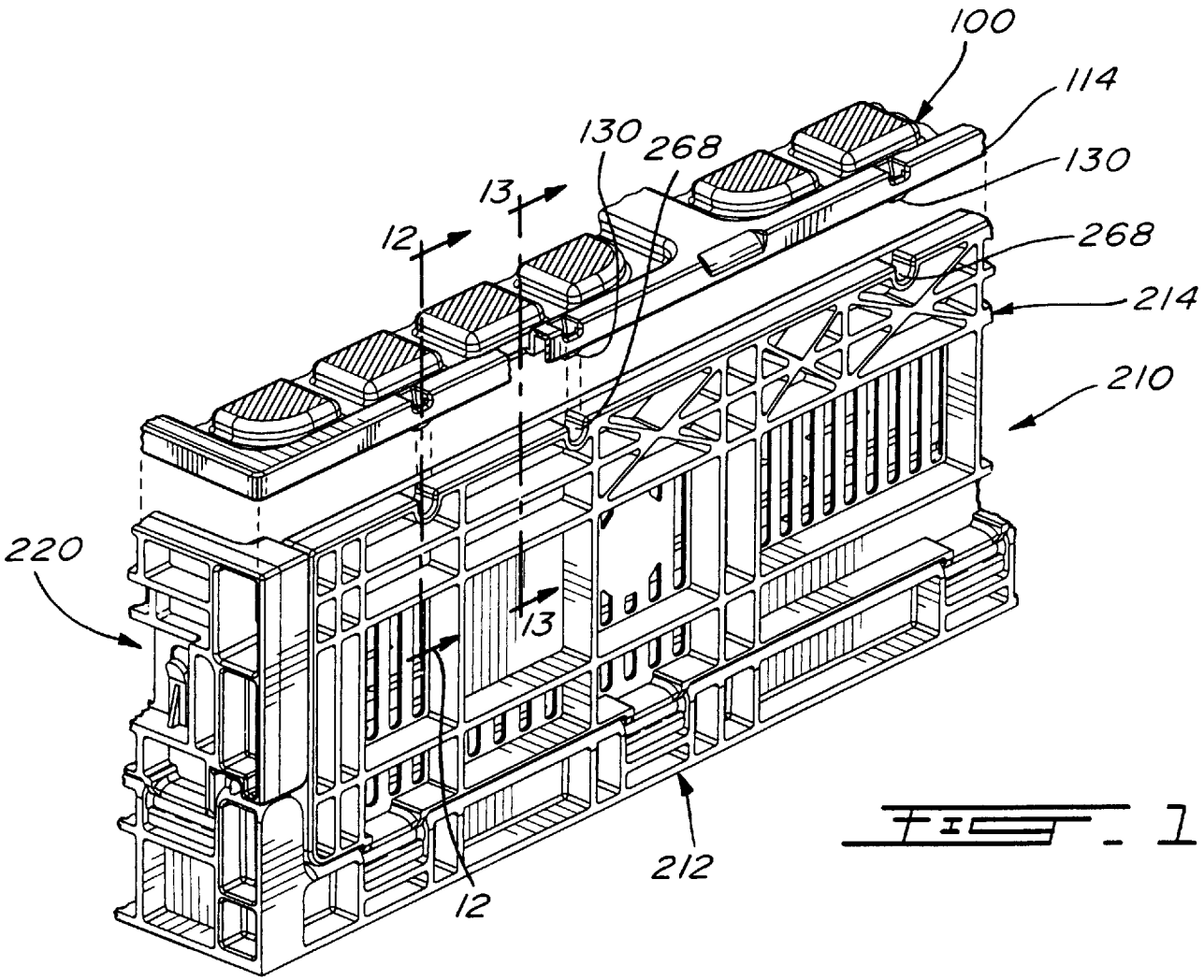
FIG. 11 is a partial perspective view of a lid over a corner of a container in the erected position.
Figure 12:
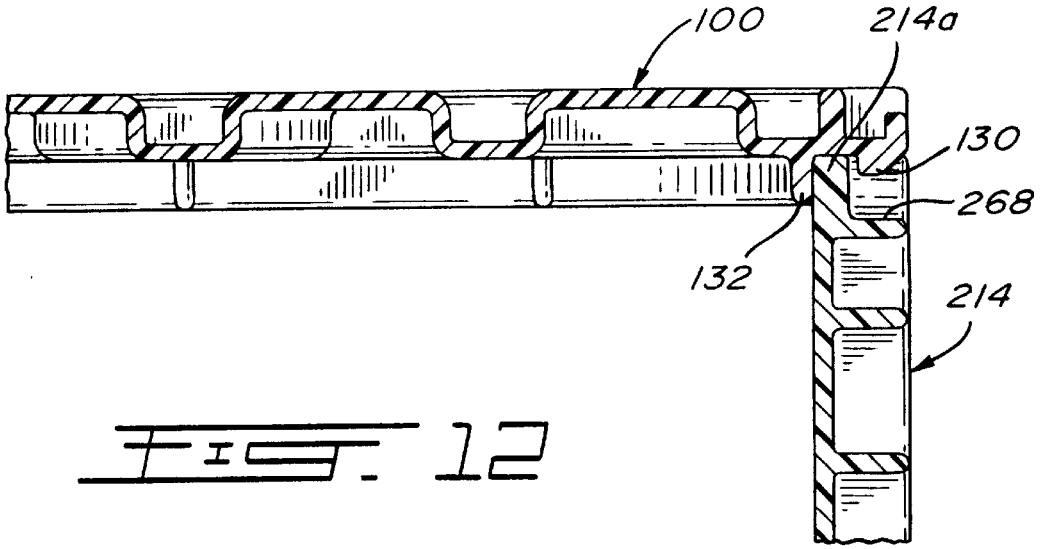
FIG. 12 is a cross-sectional view taken along lines 12—12 of FIG. 11.
Figure 13:
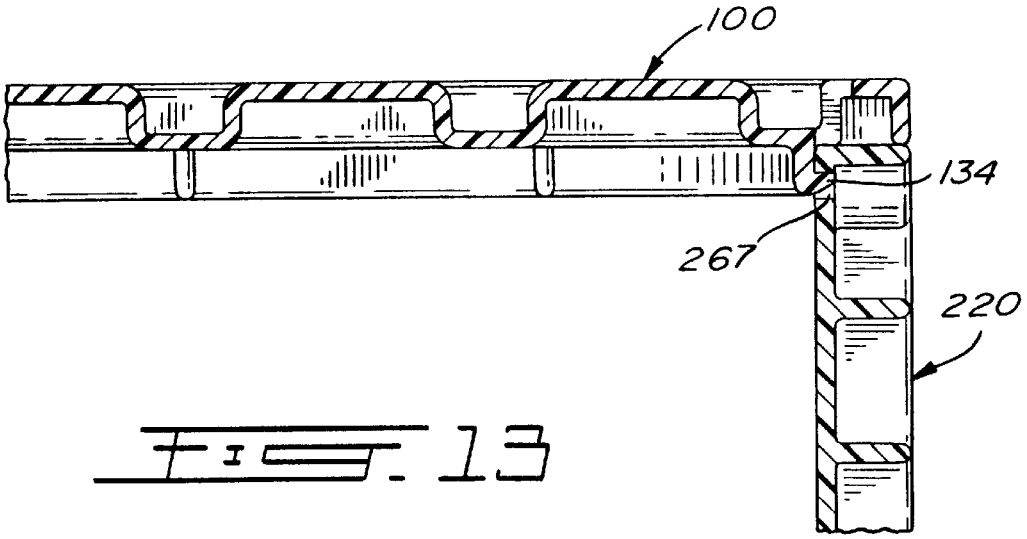
FIG. 13 is a cross-sectional view taken along lines 13—13 of FIG. 11.
Figure 14:
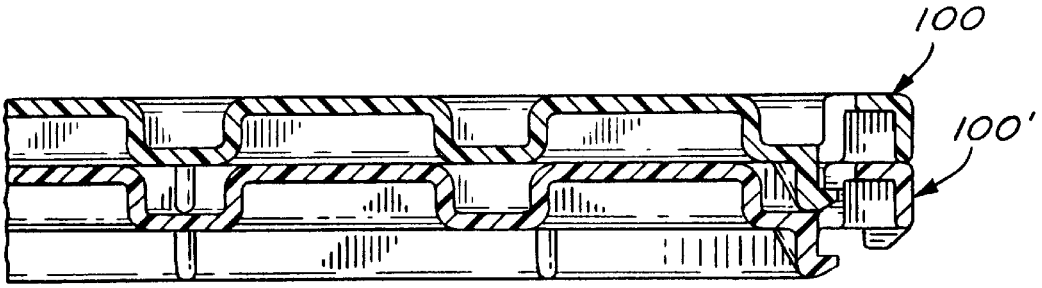
FIG. 14 is a cross-sectional view taken along lines 14—14 of FIG. 7.

Referring to FIG. 11, a partial view is illustrated showing how the peripheral edge 114 of the lid 100 engages the upper edge of the side and end pieces of the container 210. In the illustration, the projections 130 extending from the bottom of the peripheral edge 114 are received in grooves 268 of the side piece 214 (as well as in similar grooves in all the erected side and end pieces of the container). As illustrated in FIG. 12, the upper edge 214*a* bears against the longitudinal ribs 132 of the lid. Also, as illustrated in FIG. 13, the projections 134 along these ribs are snappily engaged in the openings 267 (see FIG. 8) of the container. Since the lid and container are made of plastics material, the disengagement of these projections from their associated openings 266 is achieved by slightly pulling outwards the end pieces 220 and 218 and then vertically lifting the lid off the container.

The lid covered containers can be stacked or cross-stacked in a manner similar to that illustrated in FIG. 7 as a result of the geometrical projections 118 being received in the grid-like configuration on the underside wall of the container.

Figure 15:
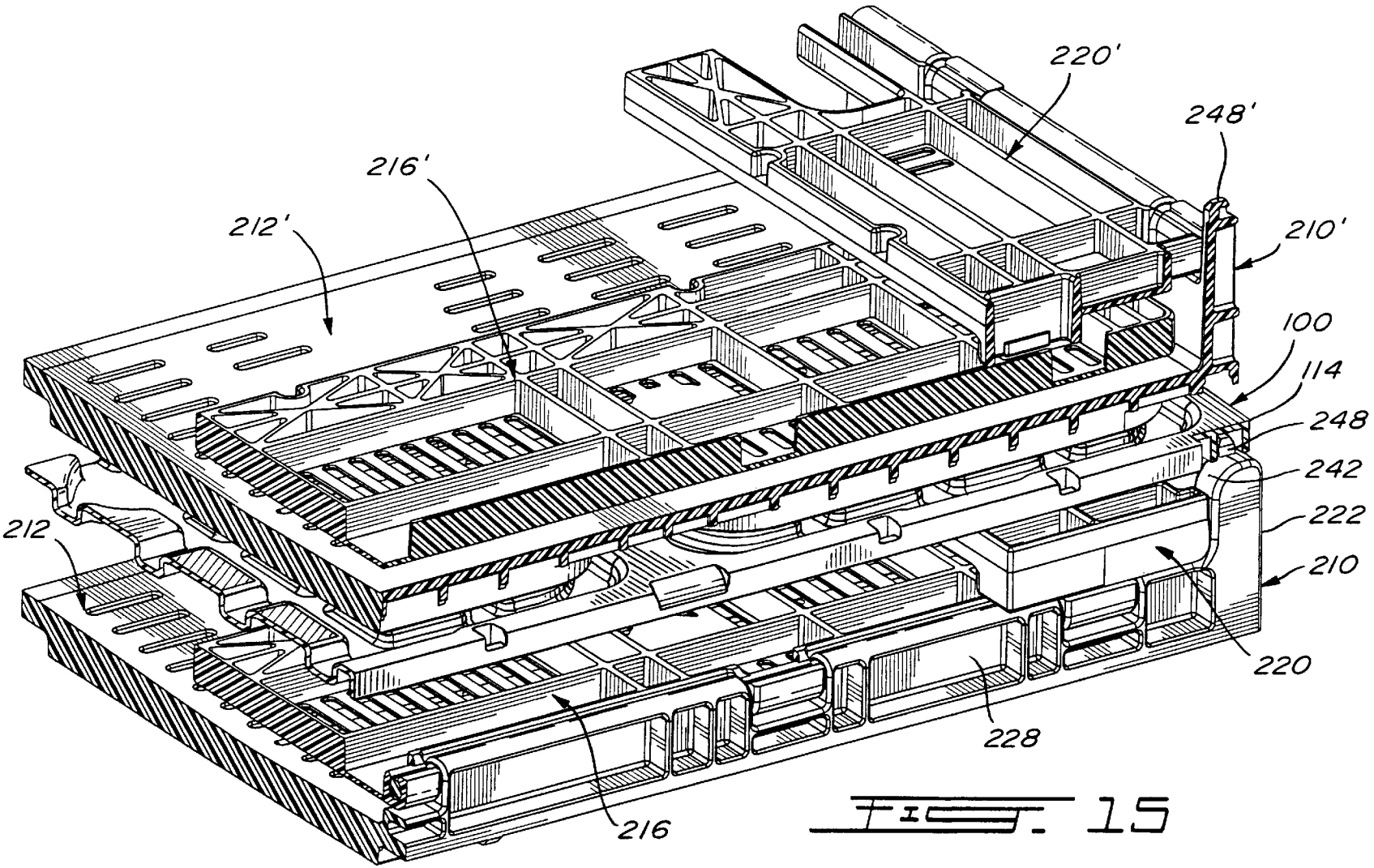
FIG. 15 is a perspective view partially showing stacked lid and containers, the latter in their folded position.

Another advantage of the present invention is that, in addition to having the lids capable of being stacked or cross-stacked, containers having their side pieces inwardly folded may still receive the lids in a stack arrangement as illustrated in FIG. 15. Two containers 210 and 210' have their side and end pieces 216 and 220, 216' and 220' folded over their bottom pieces 212, 212', respectively. The generally inverted U-shaped profile of the peripheral edge 114 of the lid 100 rests on the corner post 222 with the upper lug 248 received therein. The grid-like configuration of the bottom wall of the container (see FIG. 10) is received within the recessed areas of the top wall of the lid, the geometrical projections 118 being received within the correspondingly shaped recessed areas 264 of these grid-like configurations. Again, such stacking may include the cross stacking feature shown in FIG. 7.

Although the invention has been described above with respect with one specific form, it will be evident to a person skilled in the art that it may be modified and refined in various ways. It is therefore wished to have it understood that the present invention should not be limited in scope, except by the terms of the following claims.

We claim:

1. A container lid consisting of a rectangular body having long sides and short sides; said body having a top wall and a bottom wall; said top wall displaying a peripheral edge defining therewithin a series of recessed rectangular areas including therewithin a plurality of geometrical projections, each projection having a top face extending in a plane substantially coinciding with that of said peripheral edge; said bottom wall displaying a plurality of geometrical recesses, each complementary in shape to that of a corresponding projection of said top wall whereby identically-shaped lids may be stacked and cross-stacked in nested condition with the geometrical projections of one lid being received in corresponding geometrical recesses of a superposed lid.

2. A lid as defined in claim 1, wherein said recessed rectangular areas and said geometrical projections of said top wall define, in said bottom wall, rectangular grid-like configurations; each grid-like configuration displaying a downwardly extending rib along an outer border thereof adjacent to said long and short sides of said body.

3. A lid as defined in claim 2, wherein said outer border extending along each said short side displays, on an outer wall thereof, a projection for snap engagement of the lid to side walls of a container.

4. A lid as defined in claim 1, wherein said peripheral edge includes, on a top face thereof, a series of peripherally spaced depressions and, vertically aligned on a bottom face thereof, a series of tongues whereby the tongues of a superposed lid may be received in corresponding depressions of a lid stacked or cross-stacked therebeneath.

5. A lid as defined in claim 1, wherein a plurality of said top faces of said geometrical projections are roughened to provide friction.

6. A lid as defined in claim 1, wherein said body is formed of plastics material.

* * * * *